US005673582A

United States Patent [19]

Figge et al.

[11] Patent Number: 5,673,582

[45] Date of Patent: Oct. 7, 1997

[54] PLANETARY MILL

[75] Inventors: Dieter Figge, Essen; Hans-Ingolf Abshof, Düsseldorf, both of Germany

[73] Assignee: Mannesmann Aktiengesellschaft, Düsseldorf, Germany

[21] Appl. No.: 597,481

[22] Filed: Feb. 2, 1996

[51] Int. Cl.[6] ..... B21B 1/42

[52] U.S. Cl. ..... 72/190; 72/195

[58] Field of Search ..... 72/190, 191, 195, 72/197

[56] References Cited

U.S. PATENT DOCUMENTS 3,210,981 10/1965 Sendzimir ..... 72/190

5,287,714 2/1994 Figge et al. ..... 72/190

*Primary Examiner*—Lowell A. Larson

*Attorney, Agent, or Firm*—Cohen, Pontani, Lieberman, Pavane

[57] ABSTRACT

A planetary mill having two stationary backing bodies, located one above the other in chocks in a roll stand. Two synchronously rotary-driven cage rings are coaxially mounted on the backing bodies so as to be separated from one another. The case rings rotate in parallel planes of rotation, and respectively hold, in swing roll bearings, one end of work rolls and/or intermediate rolls arranged between the two cage rings. The rolls and the cage rings rotate together around the backing body. The rolls rest against roll-off surfaces in the area of the roll gap. The cage rings are turnable relative to one another in their planes of rotation, to permit setting of the desired rolling material profile without changing the position of the roll-off surfaces.

6 Claims, 2 Drawing Sheets

PLANETARY MILL

BACKGROUND OF THE INVENTION

1. Field of the Invention

The invention relates to a planetary mill having two stationary backing bodies, arranged one above the other in chocks in a roll stand. Two synchronously rotary-driven cage rings that are separated from one another and rotate in parallel planes of rotation are coaxially mounted on the backing bodies. Each of the two cage rings holds, one end of work rolls and/or intermediate rolls that are arranged between them and rotate together with them around the backing body.

2. Description of the Prior Art

A generic planetary mill is known from DE 4041367A1. This reference provides, for the first time in connection with a planetary mill, proposals for carrying out flatness control of the strip to be rolled. In order to achieve this control, and in recognition of the fact that flatness deviations essentially occur on a different stretch across the strip width in the roll gap, the roll-off surface of the rolls in the generic rolling mill are changed in the region of the roll gap. For this purpose, the position of the roll-off surfaces in the backing body is set in a power-operated manner, which necessarily leads to an elastic deformation of the intermediate rolls and thus of the work rolls. Various proposed constructive solutions to this problem are described in the reference.

A common disadvantage of the prior art methods is that at the point of transfer from the rotational path of the work rolls and intermediate rolls around the backing bodies to the roll-off segments, a path difference arises in the vertical direction in the area of the roll gap. This path difference gives the rolls, in the manner of a "rail joint," an impulse upon every rotation, which the mechanism must absorb. Although no deformation forces prevail at the moment of impact between the rolls and their roll-off path, increased wear nonetheless occurs at the transfer, which finally leads to sustained deterioration in rolling performance.

SUMMARY OF THE INVENTION

Starting from the problems of the prior art discussed above, it is an object of the present invention to provide a planetary mill, especially of the Platzer type, which has a profile control that permits the desired roll material profile to be satisfactorily set without changing the position of the roll-off surfaces, so that the kinks made by the rolls while running on the rotational path, which cause wear, can be avoided.

Pursuant to this object, and others which will become apparent hereafter, one aspect of the present invention resides in a planetary mill having cage rings that are turnable relative to one another in their planes of rotation.

The invention takes advantage of the fact that in a planetary mill of the generic type both the upper and the lower stack consist of two driven cage rings, which normally rotate synchronously at the same angular setting relative to one another and which guide the rolls mounted between them vertical to the direction of roll. By turning the cage rings relative to one another, it is possible to place the work rolls of each roll stack in a slanted position relative to the rolling material axis, which results, when the work rolls of both roll stacks are set at a slant in opposite directions, in a crosswise placement of the work rolls, with roll contact, in the roll gap. This crosswise placement, like the crosswise placement of the work rolls known per se in conventional strip mills, leads to a change in the strip profile, depending on the amount of angular displacement of the rolls relative to one another.

Due to the complex design of planetary mills, it is not possible to simply transfer the known crosswise placement of work rolls to such mills. The proposal that the backing bodies as well as the chocks should be left untouched and that only the cage rings should be turned relative to one another creates a very simple and functionally reliable way to set all of the rolls of a roll stack at a slant relative to the axis of roll, in order to exercise, in conjunction with the similarly slanted rolls of the opposite roll stack, the desired influence on the profile.

As a result of the crosswise placement (max. 1 degree), the work rolls and intermediate rolls run slightly inclined across the roughly cylindrical roll-off surfaces the roll-off segments. Rolls not placed crosswise run around the ideal center point and have full-breadth contact with the segment. By virtue of crosswise placement without stress, the contact without the rolling material is lost at some points and point contact arises. This is possible without disadvantage during idle operation with crosswise-placed rolls.

When rolling material is rolled, forces arise which elastically bend the work rolls and the intermediate rolls, so that when there is stress, the contact with the roll-off segment is maintained over the entire length even with crosswise-placed rolls. Given the slight angles of crosswise placement, the described deformations of the rolls lie in the hundredth of a millimeter range.

In an advantageous embodiment of the invention, the rotary drive of the cage ring is carried out via a drive shaft that penetrates centrally through the backing body and is encompassed by a centrally radially divided drive sleeve. The sleeve halves of the drive sleeve have outer teeth on their outer ends and inner teeth on their ends facing one another. One of the inner toothings has slanted teeth and, like the other inner toothing, corresponds to corresponding outer teeth on the drive shaft. The outer teeth of the drive sleeve halves each engage, respectively, with three gear wheels, which in turn drive the cage tings. Also, the drive sleeve half of each roll stack equipped with slanted inner teeth is mounted in an axially movable fashion.

The construction of the present invention implements adjustability of the cage rings in an especially unique manner. First, thanks to the central drive via the drive shaft arranged in the backing body, the torque is passed into the center of the roll stack, from where it is distributed via the described teeth to the two drive sleeve halves and passed back to the outside. There, the torque distributed in this manner is fed via three gear wheels which are permanently placed in the backing bodies as intermediate gears and correspond to corresponding inner teeth on the respective cage rings. The division of the drive sleeve into two sleeve halves then makes it possible, because one sleeve half can be moved simultaneously with the axial movement, to turn the sleeve half. Specifically, the sleeve half is turned in a forced fashion through the slanted toothing between the drive shaft and the drive sleeve half. When the slant-toothed drive sleeve half is axially moved, this drive sleeve half simultaneously turns by a certain angular degree, which causes-via the outer teeth, the gear wheels and the inner teeth-one of the cage rings to turn relative to the other, non-turned cage ring. This turning brings about, in a very simple manner, the slanted positioning of the work rolls and intermediate rolls mounted in a swinging fashion in the cage rings. An axial movement of the rolls resulting from this is absorbed in the movement play of the detachable bearing of the rolls relative to the cage ring.

According to another feature of the invention, the movable drive sleeve half is connected via an axial bearing to a coaxial sliding sleeve, which is arranged movably on the drive shaft. This sliding sleeve thus brings about the axial movement of the drive sleeve half, which, as described above, is transformed into a turning movement of the drive sleeve half and finally of the cage ring.

Advantageously, the sliding sleeve carries a tapered roll bearing as the detachable bearing of the drive shaft, which bearing is movable together with the sliding sleeve via a bushing that can be moved from the outside. The bushing may be connected to an external servo-drive via which the above-described functions of the parts can be initiated.

In an advantageous embodiment, the bushing with an outer thread is set into the backing body and, by turning the sleeve, an axial movement of the sliding sleeve with the drive sleeve half connected thereto is brought about. Advantageously, the bushings of the upper and lower roll stacks are threaded in different directions, so that a coupled turning of the bushing causes the upper roll stack to swing in one direction and the lower roll stack to simultaneously swing in the other direction by the same amount.

It is conceivable for the bushings of the roll stacks associated with the upper and lower backing bodies to be driven synchronously in opposite directions by a shared servo-motor via shafts and worm wheel connections.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
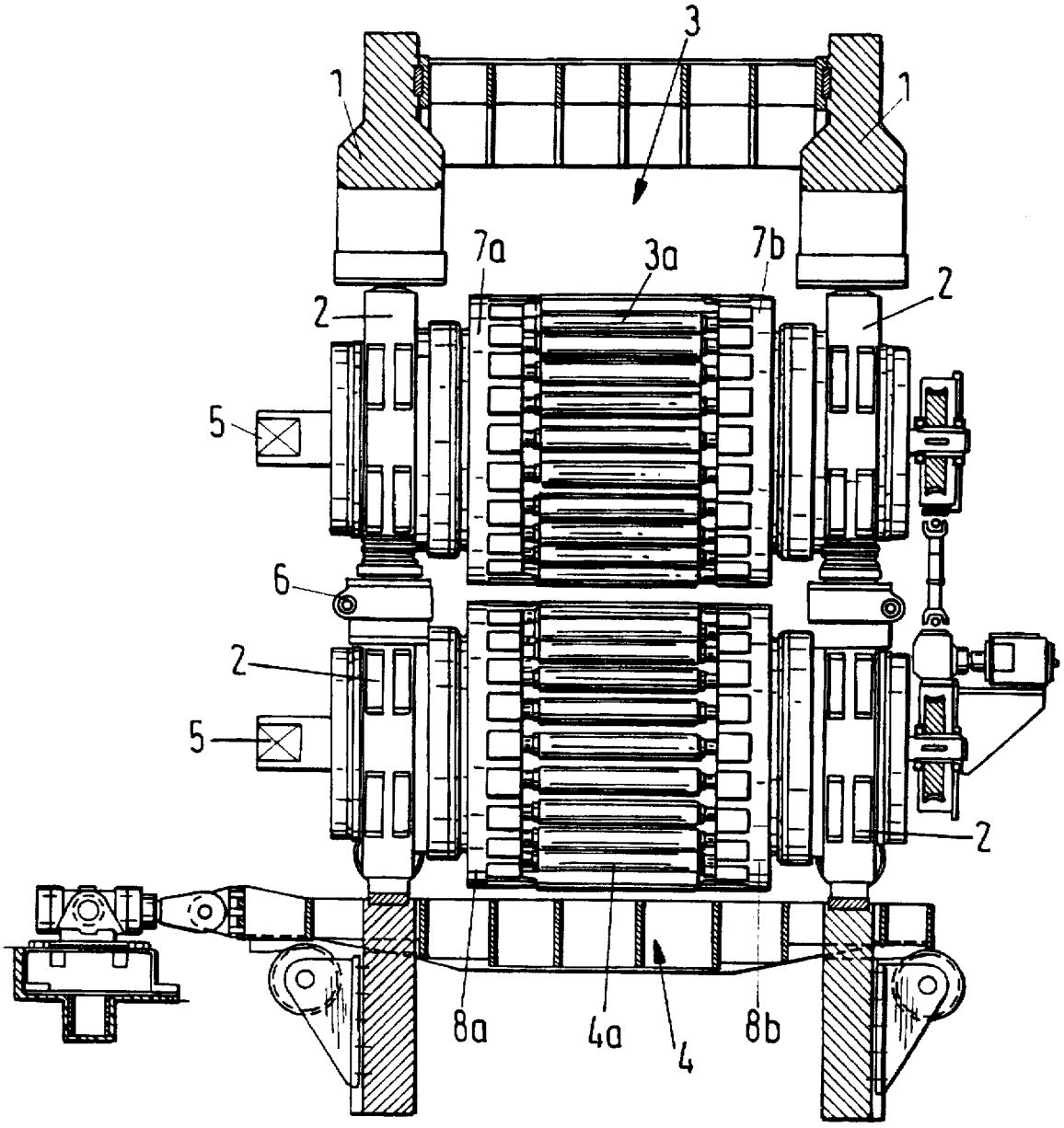
FIG. 1 is a view of a Platzer-type planetary mill showing a section through the stand housing.

FIG. 1 shows a roll stand housing 1, in which an upper roll stack 3 and a lower roll stack 4 are arranged in chocks 2. A clutch 5 of a non-illustrated drive, drives the roll stacks. The backing bodies (not shown in FIG. 1) of the respective roll stacks 3, 4 are mounted in the chocks 2. Using setting devices 6, which are known in the art and will not be described in more detail in connection with this invention, it is possible to adjust the roll stacks 3, 4 relative to one another.

The upper roll stack 3 has work rolls 3*a* and the lower roll stack 4 has work rolls 4*a*. The work rolls 3*a*, 4*a* are distributed in planetary fashion around the not-illustrated backing bodies. The ends of the work rolls 3*a* are mounted in cage rings 7*a*, 7*b*. In the same way, the work rolls 4*a* of the lower roll stack 4 are mounted in cage rings 8*a*, 8*b*. The work rolls 3*a*, 4*a* are mounted in the cage rings by swing roll bearings.

Figure 2:
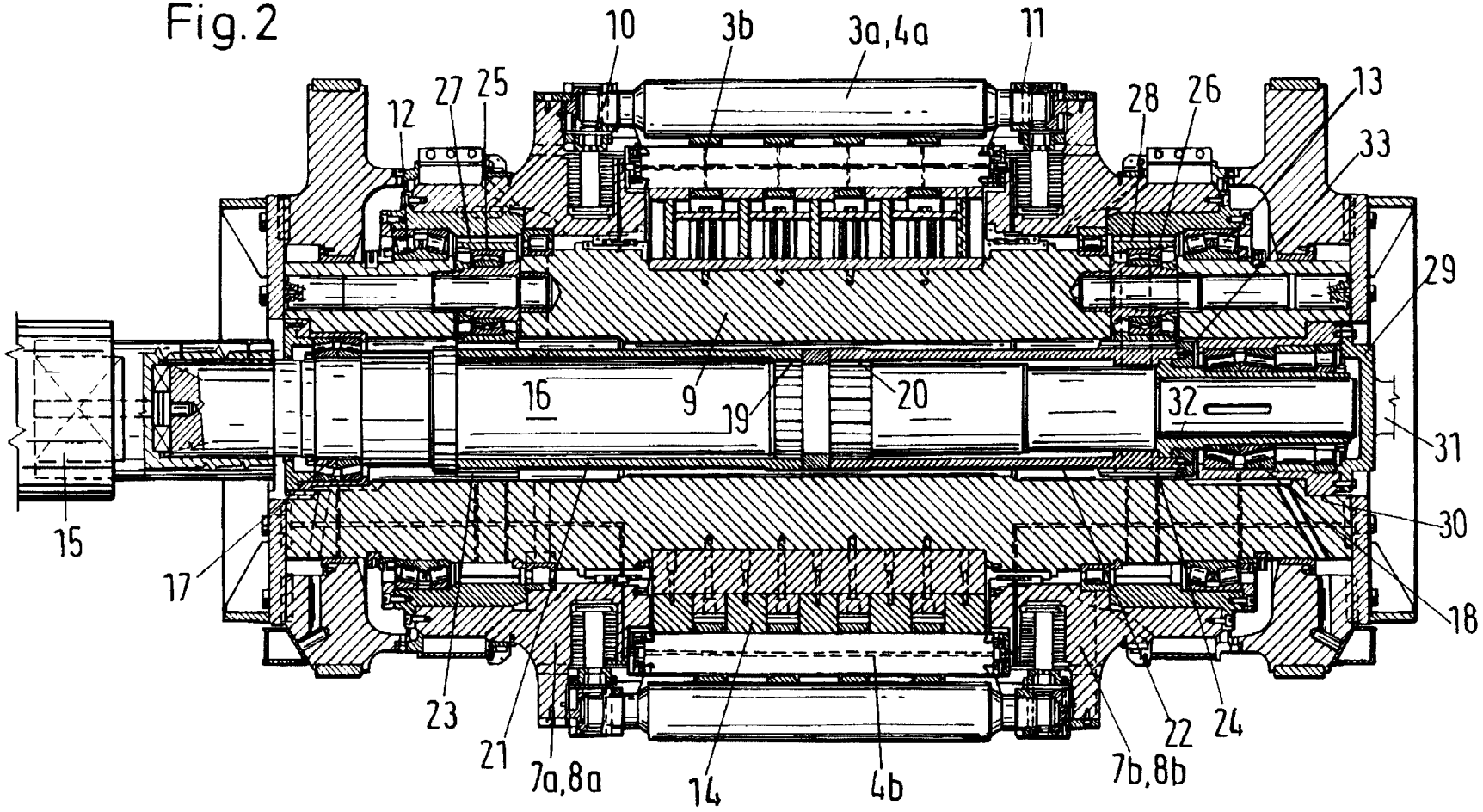
FIG. 2 shows a roll stack according to the present invention.

FIG. 2 shows a cross-section through a roll stack according to the invention. The backing body 9 of the roll stack can be seen in this figure and is mounted in the chocks 2 (FIG. 1) in a stationary, i.e., non-rotating, manner. As in FIG. 1, the work rolls 3*a*, 4*a* are mounted at their ends 10, 11 in the cage rings 7*a*, 8*a* and 7*b*, 8*b*. The cage rings are mounted on the respective backing body 9 in rotating fashion at bearings 12, 13, and cause the work rolls 3*a*, 4*a*, along with their associated intermediate rolls 3*b*, 4*b*, to rotate around the backing body 9. In the area of the roll gap, the work rolls 3*a*, 4*a* can rest against roll-off surfaces 14 of the backing body via the intermediate rolls 3*b*, 4*b*.

The rotary drive of the work rolls 3*a*, 4*a* is carried out by a drive motor (not shown) via the clutch 15, which passes the torque to a drive shaft 16. The drive shaft 16 is rotatably mounted in a fixed bearing 17 and in a detachable bearing 18 (tapered roll bearing) and is equipped with an inner toothing 19, 20 in the middle of the backing body 9. While the inner teeth 19 are designed as straight teeth, the inner teeth 20 are designed, for reasons to be explained below, as slanted teeth of a curved-tooth coupling. The two toothings 19, 20 correspond to corresponding toothings in two drive sleeve halves 21, 22, which pass the torque outward to two outer toothings 23, 24. These outer teeth 23, 24 intermesh with three spur gears 25, 26 associated with each of the two drive shaft halves 21, 22. The spur gears 25, 26 transmit the torque to the cage rings via inner teeth 27, 28 of the cage rings 7*a*, 8*a* and 7*b*, 8*b*. In this way, and by the centric introduction of the drive torque at the toothings 19, 20, it is possible to achieve an even distribution of force on the inner teeth 27, 28 of the two cage rings 7*a*, 7*b* and 7*b*, 8*b*.

For the purpose of adjusting one cage ring 7*b* or 8*b* relative to the other cage ring 7*a* or 8*a* according to the invention, the drive sleeve half 22 can be axially moved and turned relative to the drive shaft 16. The turning is caused by the above-described inner teeth 20 on the drive shaft 16 when an axial movement of the drive sleeve half 22 is simultaneously initiated. This is carried out via a bushing 29, which has an outer thread 30 that is screwed into a corresponding thread in the backing body 9. When the bushing 29 is turned via the journal 31, the bushing 29 moves axially and takes with it, via the tapered roll bearing 18, a sliding sleeve 32 connected to the bearing 18 and also connected axially to the drive sleeve half 22 by an axial bearing 33. When the drive sleeve half 22 moves axially and is forcibly turned via the inner teeth 20, the cage ring 7*b* or 8*b* is turned relative to the cage ring 7*a* or 8*a* via the spur gears 26, so that the work rolls 3*a*, 4*a* are positioned at a slant relative to the longitudinal axis of the roll stack 3, 4. The degree of rotation of the drive sleeve half 22 determines the degree of slant in the position of the work rolls 3*a*, 4*a*.

When the cage rings 7*b*, 8*b* are turned in opposite directions by the upper and lower roll stacks 3, 4, as called for according to the invention, the work rolls 3*a*, 4*a* located across from one another in the roll gap are placed crosswise or crossed relative to one another, permitting a direct influence to be exercised on the rolling material profile.

It is possible to adjust the cage rings 7*b*, 8*b* in opposite directions by virtue of fact that the bushings interconnected with one another in a geared fashion have different thread advance directions, or by virtue of the fact that the inner toothings 20 run in different directions. The drive of the journal 31 can be carried out by a shared servo-drive via shafts and worm wheels, which is known in the art and thus shown only schematically.

After the desired position has been set, the servo-motor for driving the bushing 29 can be clamped via a brake motor, so that the bushing 29 and thus the system is fixed in place.

The invention is not limited by the embodiments described above which are presented as examples only but can be modified in various ways within the scope of protection defined by the appended patent claims.

We claim:

1. A planetary mill, comprising:

a roll stand;

two stationary backing bodies arranged above one another in the roll stand;

chocks mounting the backing bodies to the roll stand;

two synchronously rotary-driven cage rings coaxially mounted on each of the backing bodies so as to be separated from one another and to rotate in parallel planes of rotation, each of the cage rings having an inner toothing;

at least one of work rolls and intermediate rolls arranged between and connected to the two cage rings on each backing body as roll stacks so that the rolls rotate together with the cage rings around the respective backing body, the rolls on one of the backing bodies forming a roll gap with the rolls on the other of the backing bodies, the backing bodies having roll-off surfaces in a region of the roll gap against which the rolls rest; and drive means for rotating the cage rings relative to one another in their planes of rotation, the drive means for the cage rings including, for each backing body:

a drive shaft that centrally penetrates through the respective backing body and has an outer toothing;

a centrally radially divided drive sleeve that encompasses the drive shaft, the drive sleeve with outer ends, and inner ends that face one another, the outer ends being provided with an outer toothing and the inner ends being provided with an inner toothing, one of the inner toothings having slanted teeth, the teeth of both inner toothings corresponding to the outer teething on the drive shaft; and spur gears arranged to engage the outer toothing of the drive sleeve halves and the inner toothing of the cage rings, the drive sleeve halves of the upper and lower roll stacks having the slant-toothed inner toothing being axially movable.

2. A planetary mill as defined in claim 1, and further comprising a coaxial sliding sleeve arranged on the drive shaft so as to be axially slidable, and an axial bearing arranged to connect the movable drive sleeve half to the coaxial sliding sleeve.

3. A planetary mill as defined in claim 2, and further comprising:

a tapered roller bearing mounted on the sliding sleeve to act as a detachable bearing of the drive shaft; and an externally accessible bushing connected to the roller bearing and turnably connected to the backing body so that movement of the bushing moves the sliding sleeve via the roller bearing.

4. A planetary mill as defined in claim 3, wherein the bushing has an outer thread and is placed into the backing body so that turning the bushing brings about an axial movement of the sliding sleeve with the movable drive sleeve half connected thereto.

5. A planetary mill as defined in claim 4, and further comprising means for synchronously driving the bushings of the roll stacks associated with the upper and lower backing bodies in opposite directions, the drive means including a shared servo-motor, shafts and worm wheel connections.

6. A planetary mill as defined in claim 3, and further comprising means for synchronously driving the bushings of the roll stacks associated with the upper and lower backing bodies in opposite directions, the drive means including a shared servo-motor, shafts and worm wheel connections.

* * * * *